US005279053A

United States Patent [19]

Pallatin et al.

[11] Patent Number: 5,279,053

[45] Date of Patent: Jan. 18, 1994

[54] CONNECTING DEVICE FOR A SLIPPER INSIDE THE SHELL OF A SKI BOOT

[75] Inventors: Pascal Pallatin, Seynod; René Borel, Cran-Gevrier, both of France

[73] Assignee: Salomon S.A., Chavanod, France

[21] Appl. No.: 958,718

[22] Filed: Oct. 9, 1992

[30] Foreign Application Priority Data

Oct. 9, 1991 [FR] France ..... 91 12638

[51] Int. Cl.[5] ..... A43B 5/04; A43B 7/14

[52] U.S. Cl. ..... 36/117; 36/88; 36/10; 36/15; 36/71

[58] Field of Search ..... 36/117, 119, 88, 89, 36/93, 10, 71, 55

[56] References Cited

U.S. PATENT DOCUMENTS

| | | | |
|---|---|---|---|
| 3,410,006 | 11/1968 | Vogel | 36/71 |
| 4,083,127 | 4/1978 | Hanson | 36/117 |
| 4,835,886 | 6/1989 | Chemello et al. | 36/93 |
| 4,864,743 | 9/1989 | Begey et al. | 36/119 |
| 4,920,666 | 5/1990 | Marega | 36/10 |
| 5,046,268 | 9/1991 | Munari | 36/119 |
| 5,174,050 | 12/1992 | Gabrielli | 36/117 |

FOREIGN PATENT DOCUMENTS

| | | |
|---|---|---|
| 0120267 | 10/1984 | European Pat. Off. . |
| 0351396 | 1/1990 | European Pat. Off. . |
| 3721620 A1 | 1/1988 | Fed. Rep. of Germany . |
| 2608384 | 5/1989 | France . |

*Primary Examiner*—Steven N. Meyers
*Assistant Examiner*—M. D. Patterson
*Attorney, Agent, or Firm*—Pollock, Vande Sande & Priddy

[57] ABSTRACT

Alpine ski boot comprising an outer shell, in which an inner slipper is placed, the shell being constituted by a shell base incorporating at least one rear cover which pivots on the shell base around a transverse axis to a pivoted open position and vice-versa, while the inner slipper comprises a rear tongue extending upward. The upper part of the rear tongue is held attached to the upper part of the rear cover by at least one connecting slide device.

6 Claims, 7 Drawing Sheets

CONNECTING DEVICE FOR A SLIPPER INSIDE THE SHELL OF A SKI BOOT

FIELD OF THE INVENTION

The present invention relates to an improvement for ski boots, and, more especially, the connection of the inner slipper to the rear pivoting portion of the outer shell. More specifically, the invention relates to an alpine ski boot constituted by a rigid shell base designed to enclose the foot and by an upper designed to enclose and surround the skier's lower leg, while allowing the skier to bend the leg forward at least partially under the effect of thrusting movements generated during skiing. This ski boot, which may be of the central-entry type, i.e., which opens by moving the two parts of the upper apart toward the front and the rear simultaneously, of the rear-entry or, again, conventional front-opening type, incorporates, according to the invention, a device for holding the slipper in place.

BACKGROUND OF THE INVENTION

The prior discloses a number of ski boots of the aforementioned type. However, in general the inner slipper is merely placed in the corresponding shell, without being truly held in place. Some manufacturers have tried to introduce improvements in these boots by designing a device for connecting the inner slipper; this is the case, for example, in the boot corresponding to European Patent Application No. EP 0351 396, which discloses an inner slipper connected to the rear cover of the upper by means of a position-retention strap arranged in the lower part of the rear tongue of the slipper. However, this type of connection is not satisfactory. In fact, when the rear cover pivots, the slipper opens only very slightly, thus making it troublesome to put on the boot; furthermore, the rear space between the tongue and the rear cover can fill with snow. Nothing restricts the rearward pivoting of the rear cover, and, when the boot is put on, insertion of the foot may cause the rear tongue belonging to the slipper to descend into the boot, a phenomenon which, of course, makes it even more difficult, and even impossible, to put on the boot.

SUMMARY OF THE INVENTION

The present invention proposes to solve the problems posed above; its purpose is to produce a boot incorporating a shell, in which the opening of the upper makes it possible to put on the boot, and which comprises a connecting slide device which connects the rear tongue of the slipper to the rear cover of the shell, thereby making it possible, when this cover is opened, to activate the tongue belonging to the slipper.

Furthermore, the connecting device comprises a stop system whose dual function is to hold the tongue depressed when the shell is in the open position and to delimit this open position of the shell by restricting the rearward pivoting of its cover. The device can also allow the slipper to be held in a raised position.

Thus, the ski boot according to the invention incorporates an outer shell in which an inner slipper is placed, the shell being constituted by a shell base comprising at least one rear cover which pivots on the shell base around a transverse axis from a closed position to a pivoted open position, and vice-versa, while the inner slipper comprises a rear tongue extending upward, the upper rear portion of the rear tongue being held attached to the upper part of the rear cover by means of a connecting slide device. The connection device comprises, by virtue of complementary features, connecting means making it possible to cause the rear tongue belonging to the inner slipper to pivot when the rear cover pivots around its transverse axis, and downward-support means for the rear tongue when the rear cover is in its pivoted open position.

According to one feature of the invention, the connecting, the activation and slide means are constituted by a vertical groove delimited laterally by two lateral walls cooperating with a pin or shaft incorporating a position-retention head. The groove connects with either the upper rear portion of the rear tongue belonging to the slipper or the upper portion of the rear cover, while the pin or shaft is attached, respectively, either to the upper part of the rear cover or to the upper rear part of the rear tongue belonging to the slipper.

BRIEF DESCRIPTION OF THE DRAWINGS

In order that the invention may be more clearly understood, reference will now be made to the accompanying drawings, wherein an embodiment of the invention is shown for purposes of illustration.

DESCRIPTION OF THE PREFERRED EMBODIMENT

Figure 1:
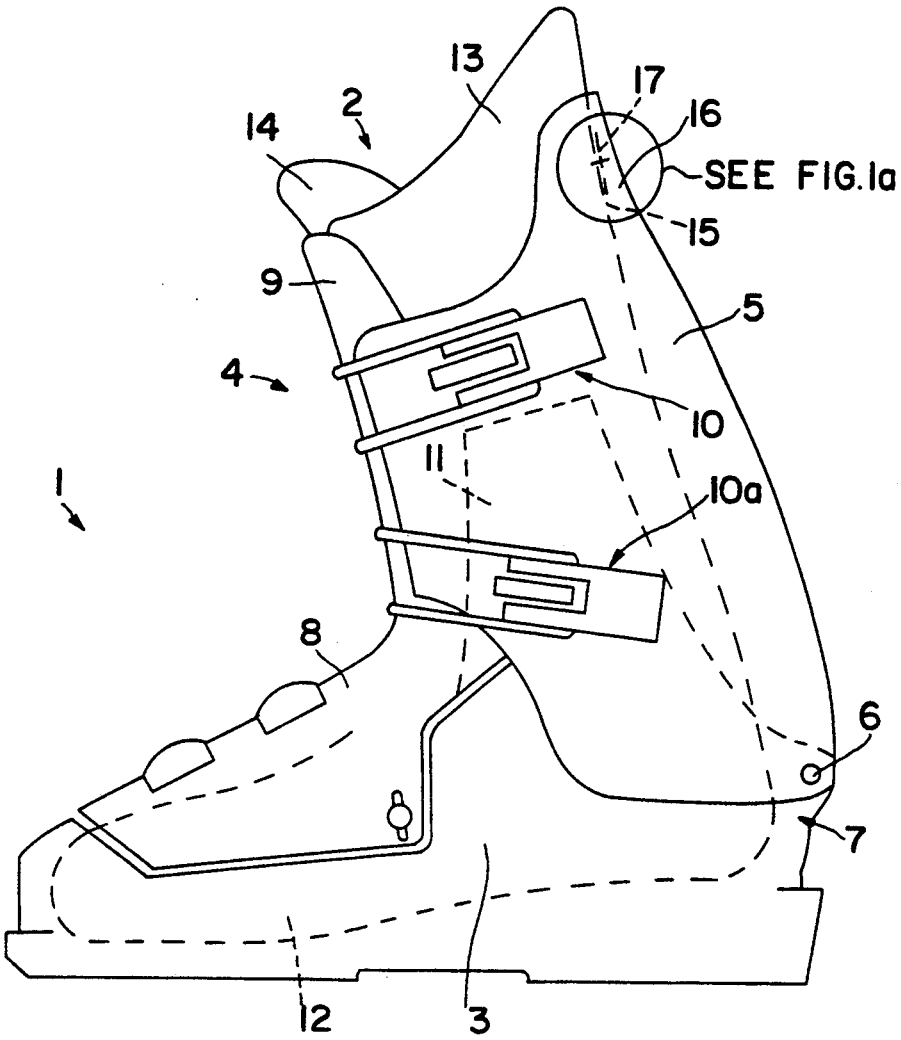
FIG. 1 is a lateral view of a ski boot according to the invention, of the central entry type, in its closed position.

The ski boot according to the invention is constituted by an outer shell 1 containing an inner slipper in which the skier's foot and lower leg are held. This outer shell 1 is conventionally manufactured from a relatively rigid material and is made up principally of a shell base 3 on which an upper 4, which encloses the skier's leg, is at least partially jointed. Furthermore, the shell base comprises two lateral wings 11 which extend it laterally and upwardly approximately along the axis of the lower leg, so as to cover the lateral areas of the skier's ankle and thus to improve lateral resistance when the edges grip the snow. The upper 4 itself comprises a rear cover 5 jointed on the shell base 3 around a hinge pin 6 which is installed, for example, in the area of the wall 7 of the heel of the shell base and which allows the rear cover to pivot from a front closed position to a rearward-pivoting open position of the boot. In this open position, the rear cover is swung to the rear to allow the skier to insert his foot in the boot. Furthermore, the rigid outer shell comprises a front closing cover 8 covering the front open area. This front closing cover 8 is extended upward by a front tongue 9, which is, for example, more flexible than its lower section. The outer shell further incorporates tightening and closing means (10, 10*a*), such as hook-and-buckles or other conventional means, thus providing the connection between the front cover 8 and the rear cover 5.

The inner slipper 2 is conventionally manufactured from a flexible material comprising padding 201 contained in a sheath 202 so as to provide for interior comfort in the boot. This slipper comprises a lower portion 12 at least partially enclosing the skier's foot and extended rearwardly and upwardly by a rear tongue 13 designed to rise along the rear portion of the lower leg and to enclose the lower leg to the rear and potentially laterally at 130, 131.

To hold the instep of the lower leg perfectly in position, the inner slipper 2 is completed by a front tongue 14. It should be noted that the rear tongue 13 is attached to the lower portion 12 of the slipper. This rear tongue may be unitary with this lower portion while forming an extension thereof, or it may be produced separately and attached to this lower portion by stitching, bonding or soldering.

According to the invention, the upper rear portion 15 of the rear tongue 13 of the slipper 2 is connected to the rear upper part 16 of the rear cover 5 by means of a connecting slide device 17, which comprises connecting means 29, 290, 20'*a*, 20'*b* which cause the rear tongue 13 of the inner slipper to pivot around its transverse axis 6 when the rear cover 5 pivots. The connecting means comprise sliding means 28, 19 and downward-support means for the rear tongue 13 when the rear cover is in the pivoted open position.

According to a further feature of the invention, the connection device is positioned on the rear upper part of the boot and holds the rear tongue 13 of the slipper 2 in place in relation to the rear cover 5 belonging to the upper 2, while at the same time allowing relative vertical movement of the rear tongue 13 in relation to the rear cover 5. To this end, for example, the rear upper part 15 of the rear tongue belonging to the slipper is provided with a catch plate 18 comprising a vertical slide groove 19 cut into a central wall 200 of the catch plate. This central wall 200 is slightly offset to the rear in relation to the main lateral walls (21*a* and 21*b*) so as to create a front housing 25 designed to receive the head of pin 28. The vertical slide groove 19 opens downward and is closed at the top so as to form a stop 26 whose function will be explained hereinbelow.

The downward opening of the groove 19 makes it possible to mount the slipper in its outer shell, this opening allowing the insertion of the head of the pin 28.

Figure 5:
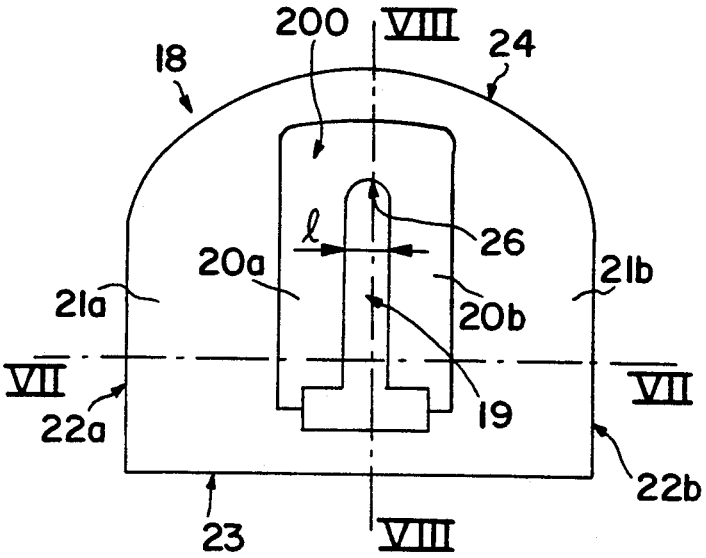
FIG. 5 is a lateral view of the catch plate.
Figure 6:
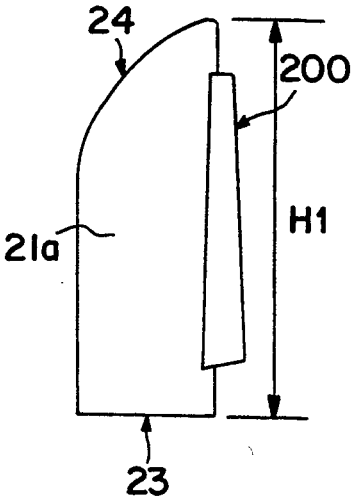
FIG. 6 is a lateral view of the catch plate.
Figure 7:
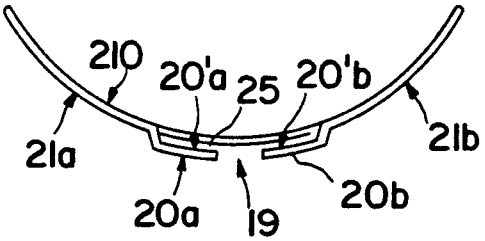
FIG. 7 is a cross-section view along line VII—VII in FIG. 5.

The upper median portion 16 of the rear cover 5 comprises a projection 27 which extends frontward, and thus toward the inside of the boot, and which is designed to cooperate with the groove 19 in the catch plate 18. The projection 27 is formed, for example, by a movable cylindrical pin 28 incorporating, at its front end, a head 29 having a diameter D greater than the diameter d of the pin. The pin is held in position by a median shoulder 30 and by an attachment screw 31. The diameter d of the pin is substantially smaller than the width 1 of the groove. Thus, in the mounted position, the pin is positioned in the groove, while the retention head is inserted in the housing 25, in such away that the edge 290 engages with the front surfaces 20'*a* and 20'*b* of the lateral walls 21*a* and 21*b* of the central wall 200 (FIG. 5).

Figure 1A:
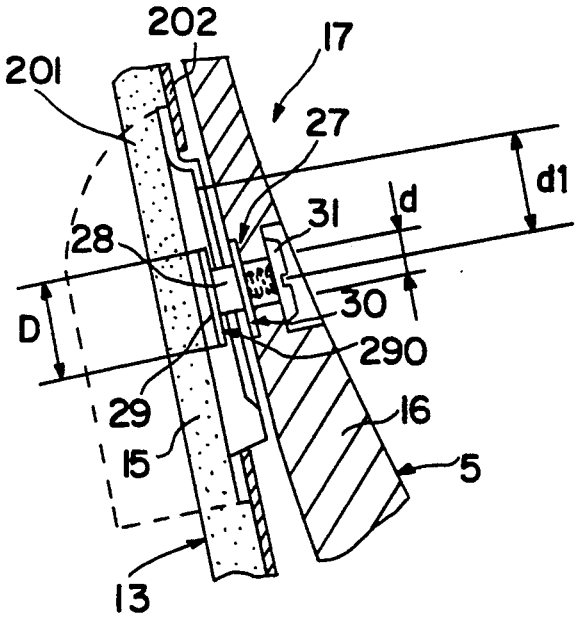
FIG. 1*a* is an enlarged cross-sectional detail view of the device which holds the slipper in place in the shell of the boot, in the boot position illustrated in FIG. 1.

FIGS. 1 and 1*a* represent the boot in its closed position. It will be seen that, in this position, the pin 28 of the projection 27 is positioned more or less in the middle of the corresponding groove 19.

Figure 2:
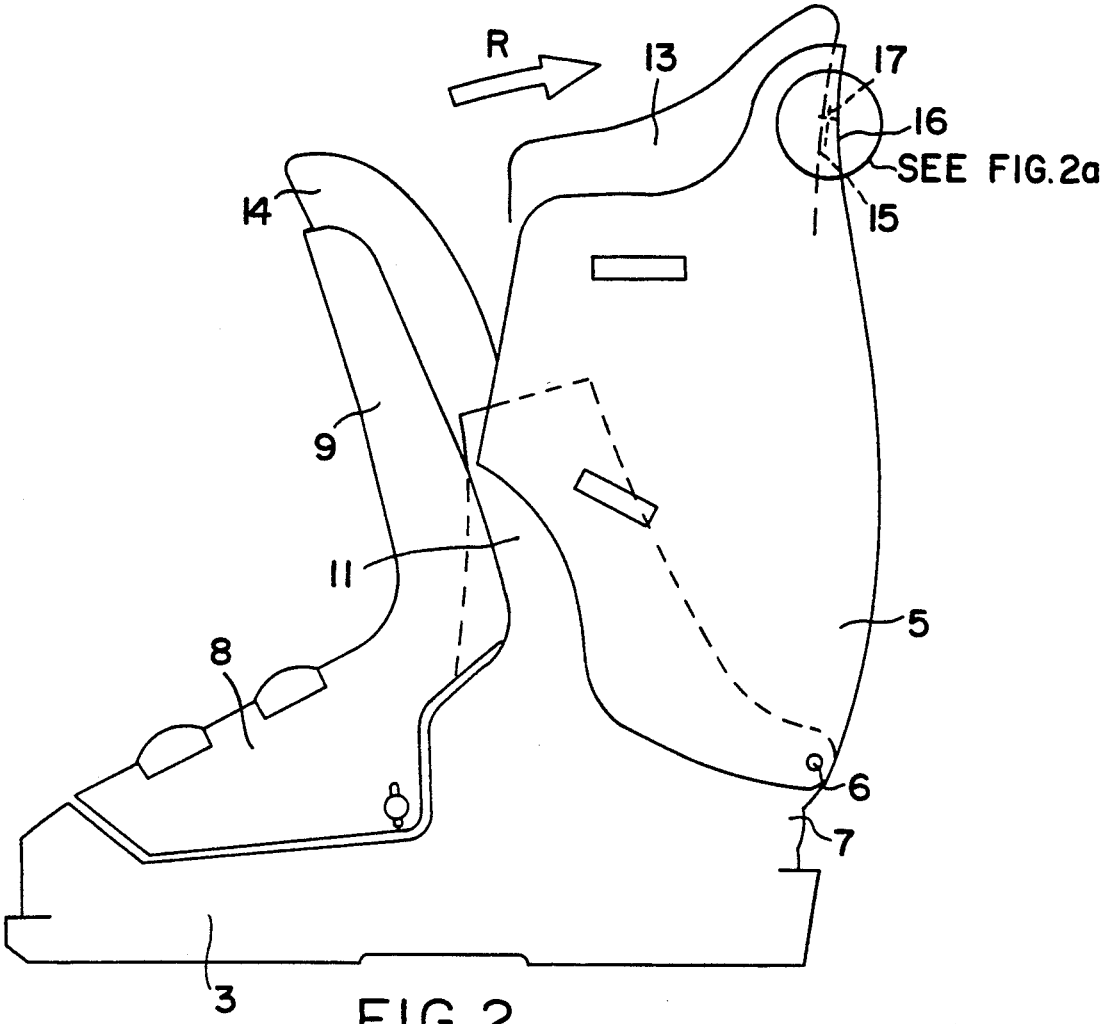
FIG. 2 is a view similar to that in FIG. 1, with the boot in the open position, the closing hooks being omitted for the sake of clarity.
Figure 2A:
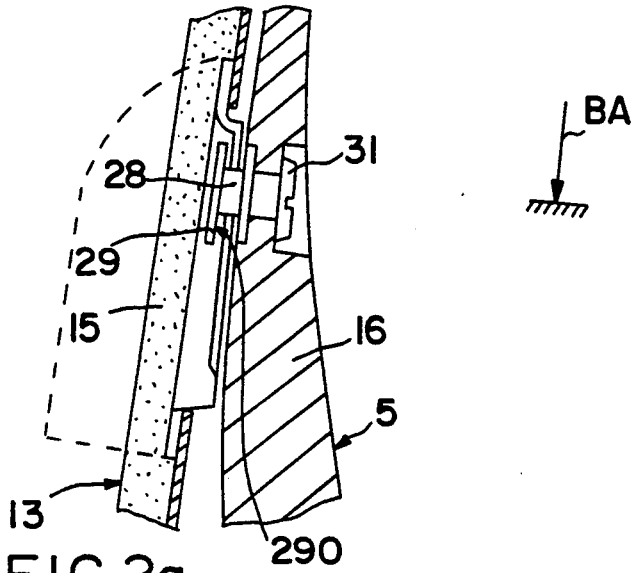
FIG. 2*a* is a view similar to that in FIG. 1*a*, the boot being in the open position shown in FIG. 2.
Figure 8:
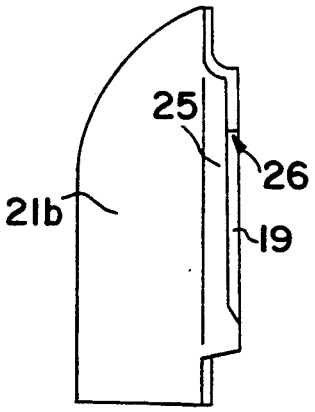
FIG. 8 is a cross-section view along line VIII—VIII in FIG. 5.

FIGS. 2 and 2*a* illustrate the same boot, but in its maximum opened position. Travel from the closed position (FIG. 1) to the open position (FIG. 2) occurs by pivoting the rear cover 5 in the direction R around the pivoting axis 6. During this pivoting movement, rear cover 5 draws with it the rear tongue 13 of the slipper, because of the cooperation of the edge 290 of the head 29 with the front surfaces 20'*a* and 20'*b* of the central wall 200 of the catch plate 18 (FIG. 5 to 8), and pin 28 moves in relative upward motion in relation to the catch plate 18. The rearward pivoting motion of the cover 5 in direction R is restricted by the fact that, at the end of a certain displacement "d1 (FIG. 1*a*)," the pin 28 comes into contact with the stop 26 in the groove 19 (FIGS. 5 and 8). In this position, which corresponds to the open position (FIGS. 2 and 2*a*), the rear tongue is thus supported downward on the pin of the rear cover 5, thus preventing it from moving downward in direction BA (FIG. 2*a*) when the boot is put on.

Figure 3:
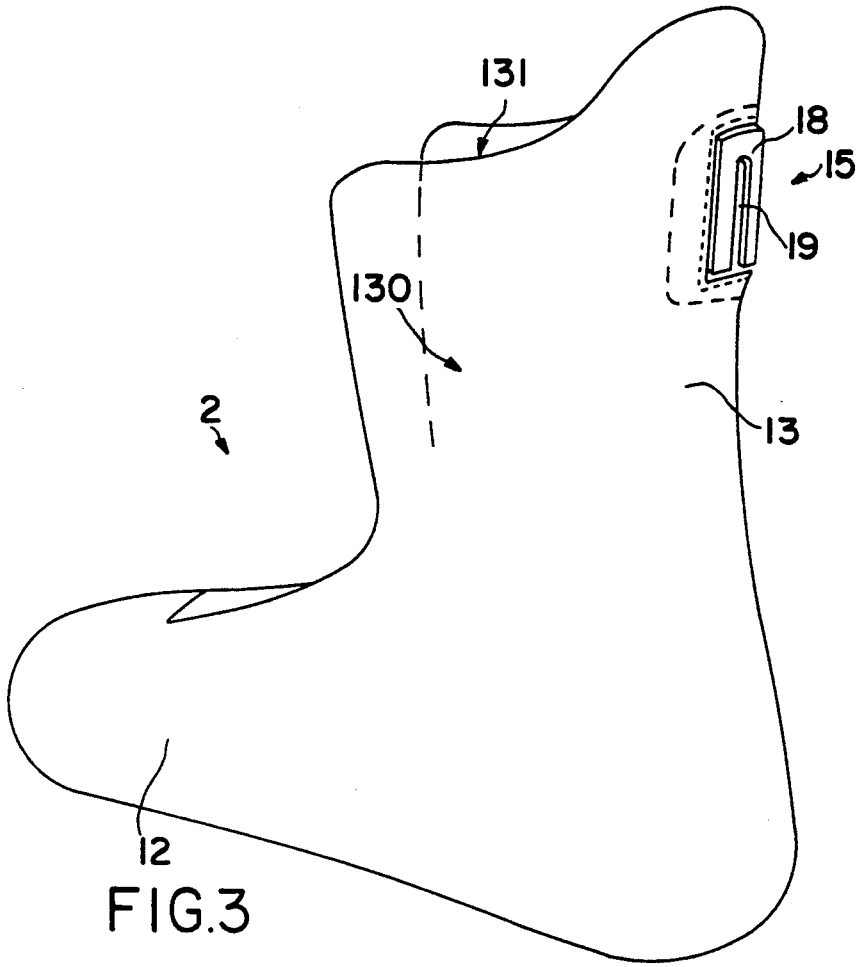
FIG. 3 is a rear perspective view of the inner slipper according to the invention.
Figure 4:
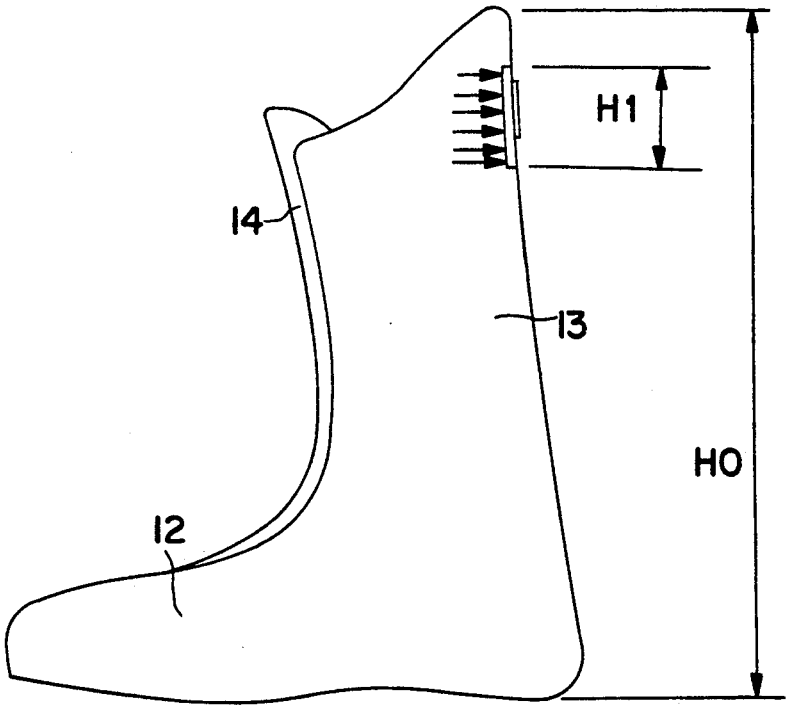
FIG. 4 is a lateral view of the slipper according to the invention.

The catch plate 18 (FIGS. 3 and 4), that the catch plate 18 is made of a relatively rigid material which is, at the least, stiffer than the slipper material, thereby improving rearward position-retention of the skier's lower leg, by virtue of the fact that the catch plate is positioned in the upper rear portion 15 of the rear tongue 13 (FIG. 1).

Figure 9:
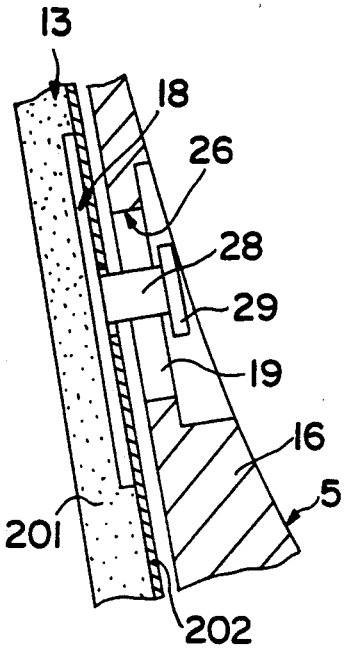
FIG. 9 is a view similar to FIG. 1*a*, showing a variant.
Figure 15:
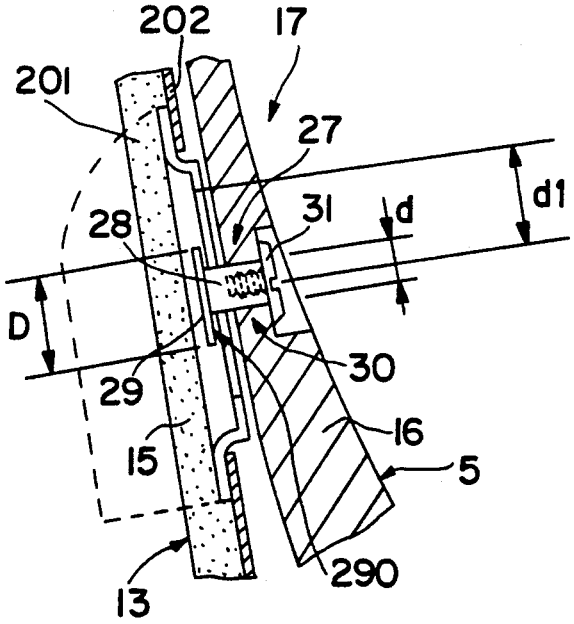
FIG. 15 illustrates the variant in FIGS. 11 to 13 in a view similar to FIG. 1*a*.

FIG. 9 is a view similar to FIG. 1*a*. It shows a variant in which the groove 19 connects with the upper rear portion 15 of the rear tongue 13 of the boot, while the pin 28 is attached to the upper portion 16 of the rear cover 5.

Figure 10:
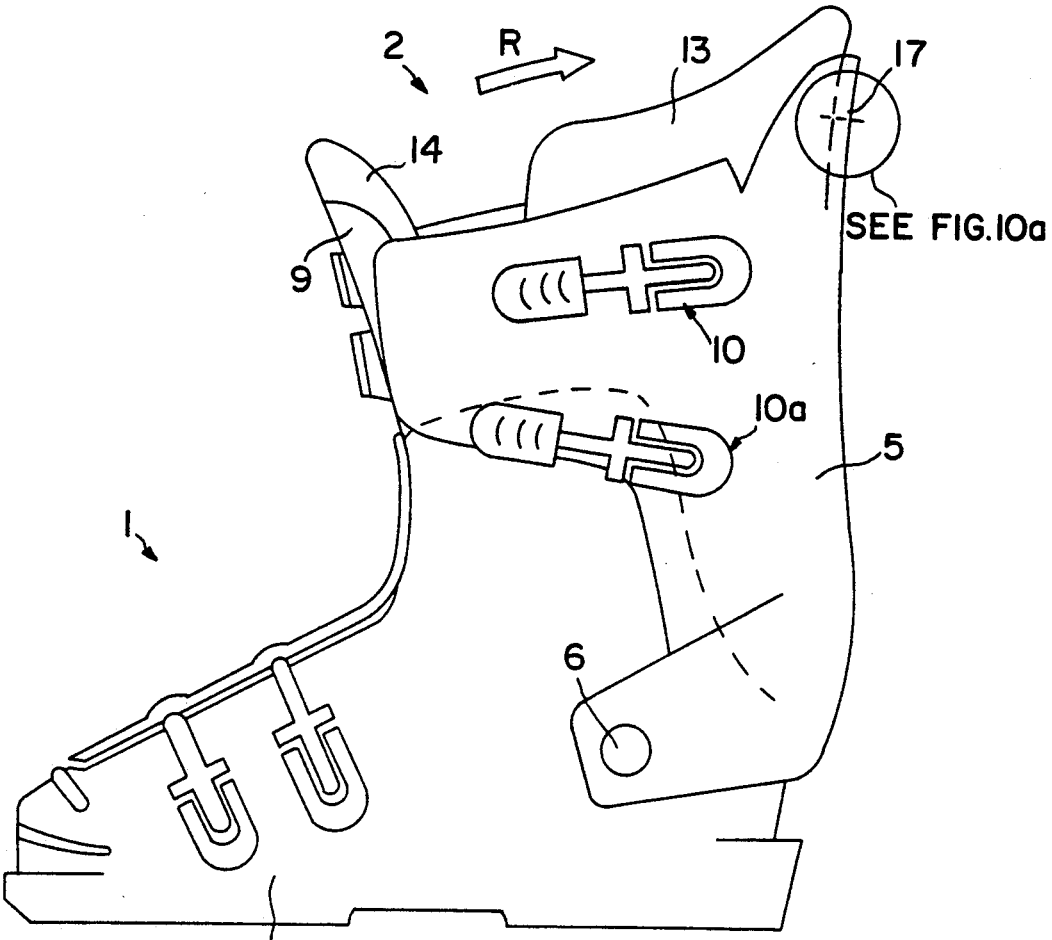
FIGS. 10 and 10*a* are views similar to FIGS. 2 and 2*a*, illustrating another type of boot equipped with the device according to the invention.
Figure 10A:
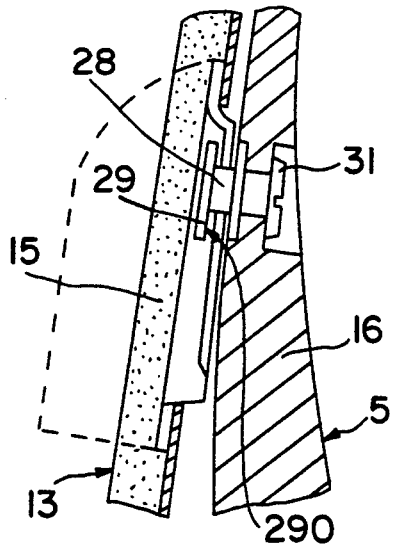
Figure 11:
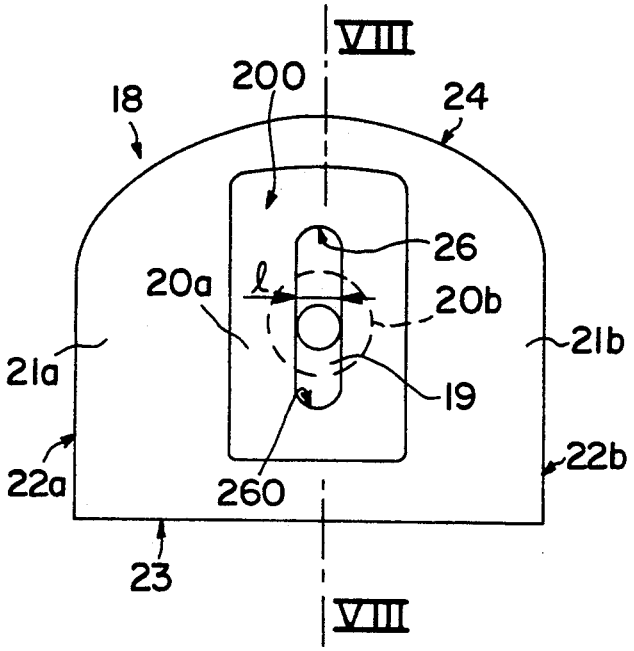
FIGS. 11, 12, and 13 are views similar to FIGS. 5, 6, and 8, illustrating a variant.
Figure 12:
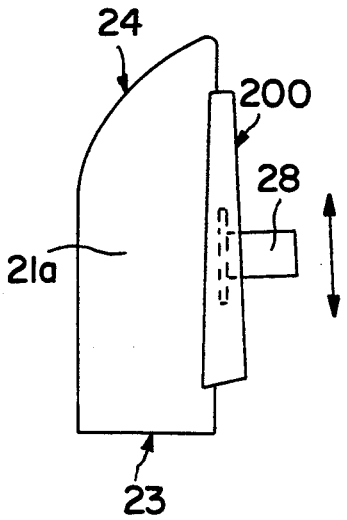
Figure 14:
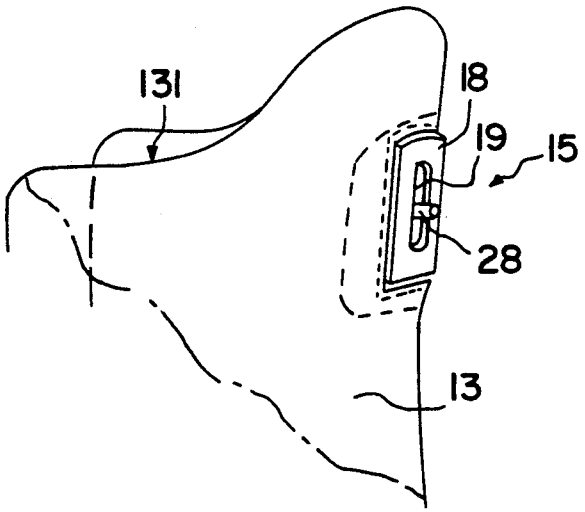
FIG. 14 is a partial view similar to FIG. 3, showing a boot equipped with the variant illustrated in FIGS. 11, 12 and 13.
Figure 13:
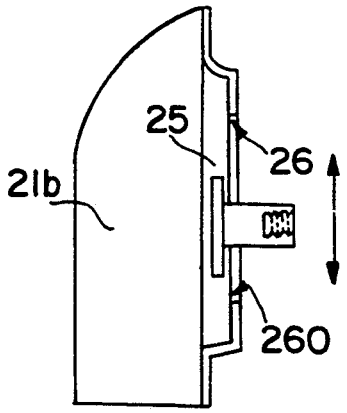

FIGS. 10 and 10*a* are views similar to FIGS. 2 and 2*a*, illustrating another type of boot equipped with the device according to the invention. To better understand these figures, elements similar to the other embodiments bear the same reference numbers. Thus, the upper incorporates a rear cover 5 jointed to the shell base 3 around a pin 6, and the rear tongue 13 of the inner slipper 2 is attached to this rear cover by means of the inventive device 17.

FIGS. 11 to 15 illustrate a variant in which the groove 19 in the catch plate is also closed at the bottom so as to form a stop 260 for a pin 28 held immovably in this groove and designed to cooperate with a corresponding hole in the rear cover 5.

What is claimed is:

1. Alpine ski boot comprising an outer shell (1) in which an inner slipper (2) is placed, said shell being constituted by a shell base (3) comprising at least one rear cover (5) which pivots on said shell base around a transverse axis (6) between a closed position and an open position, said inner slipper comprising an upwardly extending rear tongue comprising a rear upper portion (15) connected to an upper part (16) of said rear cover (5) by connection means (17) comprising means (**29, 290, 20'*a*, 20'*b*) causing said rear tongue (13) to pivot when said rear cover (5) pivots around said transverse axis (6), said connecting means comprising sliding means (28, 19, 18) constituted by a vertical groove (19) delimited laterally by two lateral walls (20*a*, 20*b*) which cooperate with a pin (28) comprising a head (29) having a diameter greater than a width of said groove, said groove (19) being provided on a central part (200) of a catch plate (18) attached to said rear upper part (16) of said rear tongue of said slipper, while said pin (28**) projects to an inside of said shell so as to cooperate with said groove.

2. Alpine ski boot according to claim 1, wherein said connection means (17) comprises downward stop means (28, 26) for said rear tongue (13) restricting rearward pivoting of said rear cover.

3. Alpine ski boot according to claim 1, wherein said groove (19) is located on said rear upper portion (15) of said rear tongue (13) of said slipper, while said pin (28) is attached to said upper part (16) of said rear cover (15).

4. Alpine ski boot according to claim 1, wherein said groove (19) is located on said upper part (16) of said rear cover (15), while said pin (28) is attached to said rear upper portion (15) of said rear tongue (13) of said slipper.

5. Alpine ski boot according to claim 1, wherein said central part (200) of said catch plate (18) comprises two lateral walls (**20*a*, 20*b*) cooperating with an edge (290) of said head (29) of said pin (28**).

6. Alpine ski boot according to claim 5, wherein said catch plate (18) is made of a material which is more rigid than a material of said inner slipper.

* * * * *